US009439824B1

(12) United States Patent
Shimmel, Sr.

(10) Patent No.: US 9,439,824 B1
(45) Date of Patent: Sep. 13, 2016

(54) BACK STRETCHING DEVICE

(71) Applicant: Michael Alan Shimmel, Sr., Streetboro, OH (US)

(72) Inventor: Michael Alan Shimmel, Sr., Streetboro, OH (US)

( * ) Notice: Subject to any disclaimer, the term of this patent is extended or adjusted under 35 U.S.C. 154(b) by 0 days.

(21) Appl. No.: 14/631,597

(22) Filed: Feb. 25, 2015

(51) Int. Cl.

| | |
|---|---|
| ***A63B 26/00*** | (2006.01) |
| ***A63B 1/00*** | (2006.01) |
| ***A61H 1/02*** | (2006.01) |
| ***A63B 23/02*** | (2006.01) |
| *A63B 21/04* | (2006.01) |

(52) U.S. Cl.

CPC ..... *A61H 1/0292* (2013.01); *A63B 23/0238* (2013.01); *A61H 1/0229* (2013.01); *A61H 2201/1623* (2013.01); *A61H 2201/1626* (2013.01); *A61H 2203/0456* (2013.01); *A61H 2203/0481* (2013.01); *A61H 2205/081* (2013.01); *A63B 21/0442* (2013.01); *A63B 21/4007* (2015.10); *A63B 23/0233* (2013.01); *A63B 2208/0252* (2013.01); *A63B 2208/0285* (2013.01); *A63B 2210/50* (2013.01)

(58) Field of Classification Search

CPC ..... A63B 1/00; A63B 1/005; A63B 3/00; A63B 7/00; A63B 7/02; A63B 7/08; A63B 7/085; A63B 17/00; A63B 17/02; A63B 17/04; A63B 19/00; A63B 19/04; A63B 23/00; A63B 23/02; A63B 23/0205; A63B 23/0233; A63B 23/0238; A63B 2023/003; A63B 2023/006; A63B 2071/009; A63B 2208/0242; A63B 2208/0252; A63B 2208/0257; A63B 2208/0285; A63B 2210/50; A63B 2210/52; A63B 2210/54; A63B 2210/56; A63B 2210/58; A63B 21/00; A63B 21/00043; A63B 21/00047; A63B 21/02; A63B 21/04; A63B 21/0407; A63B 21/0414; A63B 21/055; A63B 21/0552; A63B 21/4007; A63B 26/00; A63B 21/0442; A61H 1/02; A61H 1/0222; A61H 1/0229; A61H 1/029; A61H 1/0292; A61H 2201/0161; A61H 2201/1623; A61H 2201/1626; A61H 2201/165; A61H 2203/0443; A61H 2203/0456; A61H 2203/0468; A61H 2203/0481; A61H 2205/081; A61H 3/008; A61H 2011/005; A47D 1/10; A47D 13/046; A47D 13/107; A47D 13/025; A47C 15/006; A47C 15/008; A63G 9/14; A63G 9/00; A01D 67/04

USPC ..... 482/143

See application file for complete search history.

(56) References Cited

U.S. PATENT DOCUMENTS 3,178,180 A * 4/1965 Morgan ..... A63B 23/0233 482/145

3,526,400 A * 9/1970 Bottjer ..... A63G 9/16 472/119

(Continued)

*Primary Examiner* — Oren Ginsberg

*Assistant Examiner* — Joshua Lee

(74) *Attorney, Agent, or Firm* — Quickpatents, LLC; Kevin Prince

(57) ABSTRACT

A device for promoting the extension of the sacrospinal muscles of a person resting on a horizontal surface includes stand having a horizontal cross bar fixed at opposing ends thereof with one each of a front pair legs and a rear pair of legs. Each front leg is pivotally fixed with the cross bar and configurable in both collapsed and extended configurations. At least one rigid post projects away from the cross bar, and at least one elastomeric band, when suspended from the at least one post, is capable of supporting the person around his sacrospinal muscles above the horizontal surface. The front and rear legs rest on the horizontal surface such that the cross bar is elevated above the horizontal surface sufficiently high enough to accommodate the person thereon in a supine position.

6 Claims, 3 Drawing Sheets

(56) References Cited

U.S. PATENT DOCUMENTS 3,532,356 A * 10/1970 Lillibridge ..... A47D 13/04 248/431
4,531,514 A * 7/1985 McDonald ..... A61H 1/0218 482/144
4,609,193 A * 9/1986 Paris ..... A61H 1/0218 482/142
4,753,438 A * 6/1988 Paris ..... A61H 1/0218 482/144
4,948,120 A * 8/1990 Krueger ..... A47D 13/107 297/274
5,531,656 A * 7/1996 Varghese ..... A63G 9/00 297/274
5,605,169 A * 2/1997 Light ..... A61H 3/04 135/66
5,704,882 A * 1/1998 Coates ..... A47C 3/0252 297/273
5,876,311 A * 3/1999 Coates ..... A47C 3/0252 297/274
6,129,693 A * 10/2000 Peterson ..... A61F 5/024 297/338
6,277,028 B1 * 8/2001 Liu ..... A47D 13/105 248/163.2
7,294,094 B1 * 11/2007 Howle ..... A61H 3/00 135/67
8,038,158 B1 * 10/2011 White ..... A47D 13/04 280/32.5
8,105,216 B2 * 1/2012 Hazan ..... A63B 21/0552 482/129
8,182,356 B2 * 5/2012 Hylton ..... A61H 1/02 472/118
8,784,284 B1 * 7/2014 Smith ..... A47D 13/08 482/121
9,168,461 B1 * 10/2015 Chen ..... A63G 9/14
2005/0003938 A1 * 1/2005 Henderson ..... A63B 21/068 482/143
2005/0209069 A1 * 9/2005 Biernacki ..... A63B 21/068 482/96
2007/0070817 A1 3/2007 Fluegge
2009/0306568 A1 * 12/2009 Meyer ..... A61H 1/0218 602/33
2010/0279837 A1 * 11/2010 Stengel ..... A61H 1/0218 482/143
2013/0324383 A1 * 12/2013 Rogers ..... A63B 26/00 482/142
2014/0249461 A1 * 9/2014 Bissell ..... A61H 1/0218 602/36
2015/0297948 A1 * 10/2015 Meister ..... A63B 23/03566 482/122

* cited by examiner

BACK STRETCHING DEVICE

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to back extension devices, and more particularly to a non-inverting back extension device.

DISCUSSION OF RELATED ART

Stretching of a person's sacrospinal muscles, or back muscles, is typically handled through traction devices wherein the person is vertically inverted. Such exercising or stretching devices are cumbersome and difficult to use. Further, a person can only change positions, which may not be long enough for the intended muscle groups to be stretched adequately.

US Patent Application 2007/0070817 to Fluegge on Mar. 29, 2007 teaches a stretching and exercising device that utilizes an elastomeric band stretched between two handles. Such a device, while suited for stretching fee or the like while holding the handles, is ill-suited for stretching one's back muscles in a way similar to traction since it doesn't allow for suspending a person above a surface to let gravity stretch the sacrospinal and other muscles.

Therefore, there is a need for a device that allows a person to stretch the sacrospinal and other muscle groups without being inverted. Such a needed device would be relatively simple to manufacture and use, and would be easy to store in a collapsed position. The needed invention would further accommodate various other stretching and exercising techniques. The present invention accomplishes these objectives.

SUMMARY OF THE INVENTION

The present device is a device for promoting the extension of the sacrospinal muscles of a person resting on a horizontal surface, and performing other exercises and stretching positions.

A stand has a horizontal cross bar fixed at opposing ends thereof with one each of a front pair legs and a rear pair of legs. Each front leg is pivotally fixed with the cross bar and configurable in both a collapsed configuration wherein the front and rear legs are substantially parallel and proximate each other, and in an extended configuration wherein each front leg pivots outwardly to form an angle with one of the rear legs of between 45 and 120-degrees. The front and rear legs rest on the horizontal surface such that the cross bar is elevated above the horizontal surface sufficiently high enough to accommodate the person thereon in a supine position. Preferably the front legs are shorter than the rear legs so that the horizontal cross bar is not centered in the device when in-use, allowing a wider variety of exercise positions.

At least one rigid post projects away from the cross bar, and at least one elastomeric band, when suspended from the at least one post, is capable of supporting the person around his sacrospinal muscles above the horizontal surface. Preferably there are two posts, but the device may also include a single flat bar. Each post is preferably made from a rigid metal material welded onto the cross bar or otherwise fixedly attached thereto. The at least one elastomeric band may be a plurality of elastic bands, each with varying elasticity so as to allow persons of varying weights to use the device effectively.

In one embodiment, a collapsible, locking angle bracket is fixed between each pair of corresponding front and rear legs. Each angle bracket when in a fully extended position prevents the front and rear legs, from exceeding a predetermined angle of separation. To collapsed configuration, such an angle bracket can assume a collapsed position that does not extend past either the front or rear legs.

The present invention is a device that allows a person to stretch the sacrospinal and other muscle groups without being inverted. The present device is relatively simple to manufacture and use, and is easy to store and transport in a collapsed position. The present invention accommodates various other stretching and exercising techniques. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
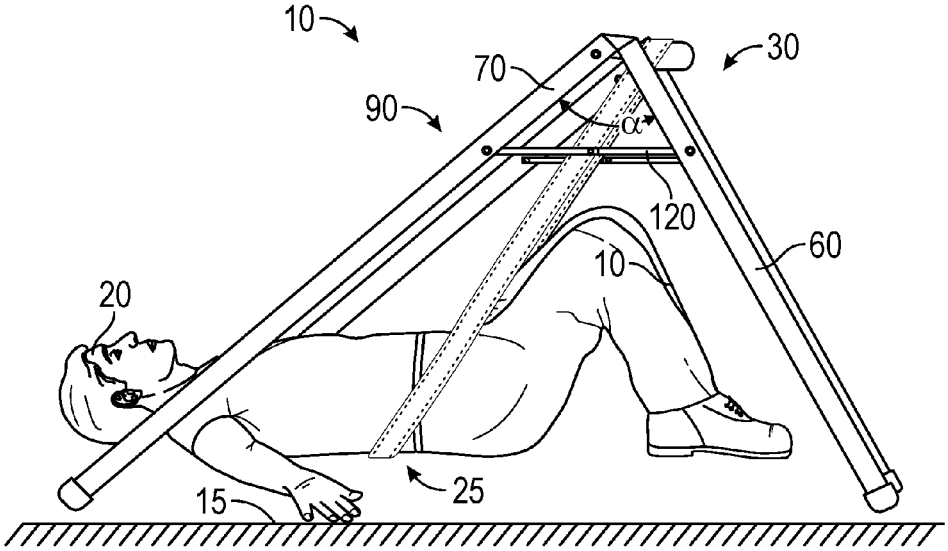
FIG. 1 is a side perspective view of the invention.
Figure 2:
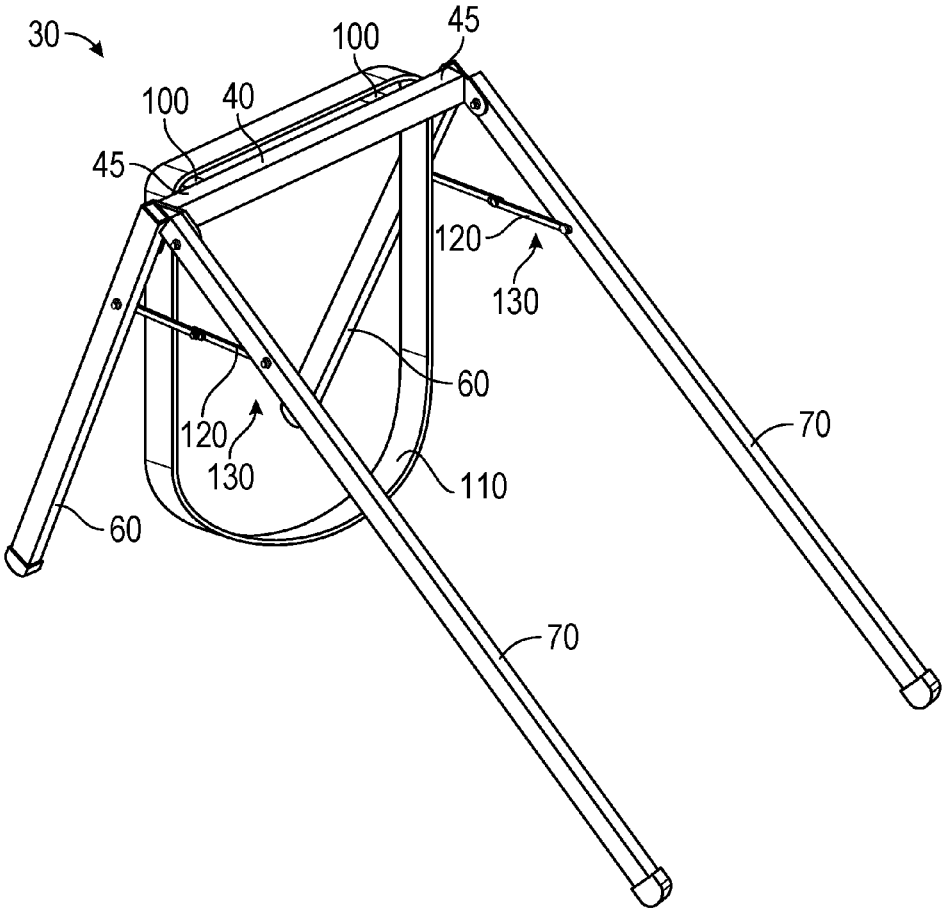
FIG. 2 is a perspective view of one embodiment thereof.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-4 illustrate a device 10 for promoting the extension of the sacrospinal muscles 25 of a person 20 resting on a horizontal surface 15, as well as other exercises and stretching positions.

A stand 30 has a horizontal cross bar 40 fixed at opposing ends 45 thereof with one each of a front pair legs 60 and a rear pair of legs 70. Each front leg 60 is pivotally fixed with the cross bar 40 and configurable in a collapsed configuration 80 (FIG. 4) wherein the front and rear legs 60,70 are substantially parallel and proximate each other, and in an extended configuration 90 (FIGS. 1-3) wherein each front leg 60 pivots outwardly to form an angle α with one of the rear legs 70 of between 45 and 120-degrees. The front and rear legs 60,70 rest on the horizontal surface 15 such that the cross bar 40 is elevated above the horizontal surface 15 sufficiently high enough to accommodate the person 20 thereon in a supine position. Preferably the front legs 60 are shorter than the rear legs 70 so that the horizontal cross bar 40 is not centered in the device 10 when in-use, allowing a wider variety of exercise positions. The cross bar 40, front legs 60, and rear legs 70 are all made from a rigid metal material, such as aluminum or steel square tubing, or the like.

Figure 3:
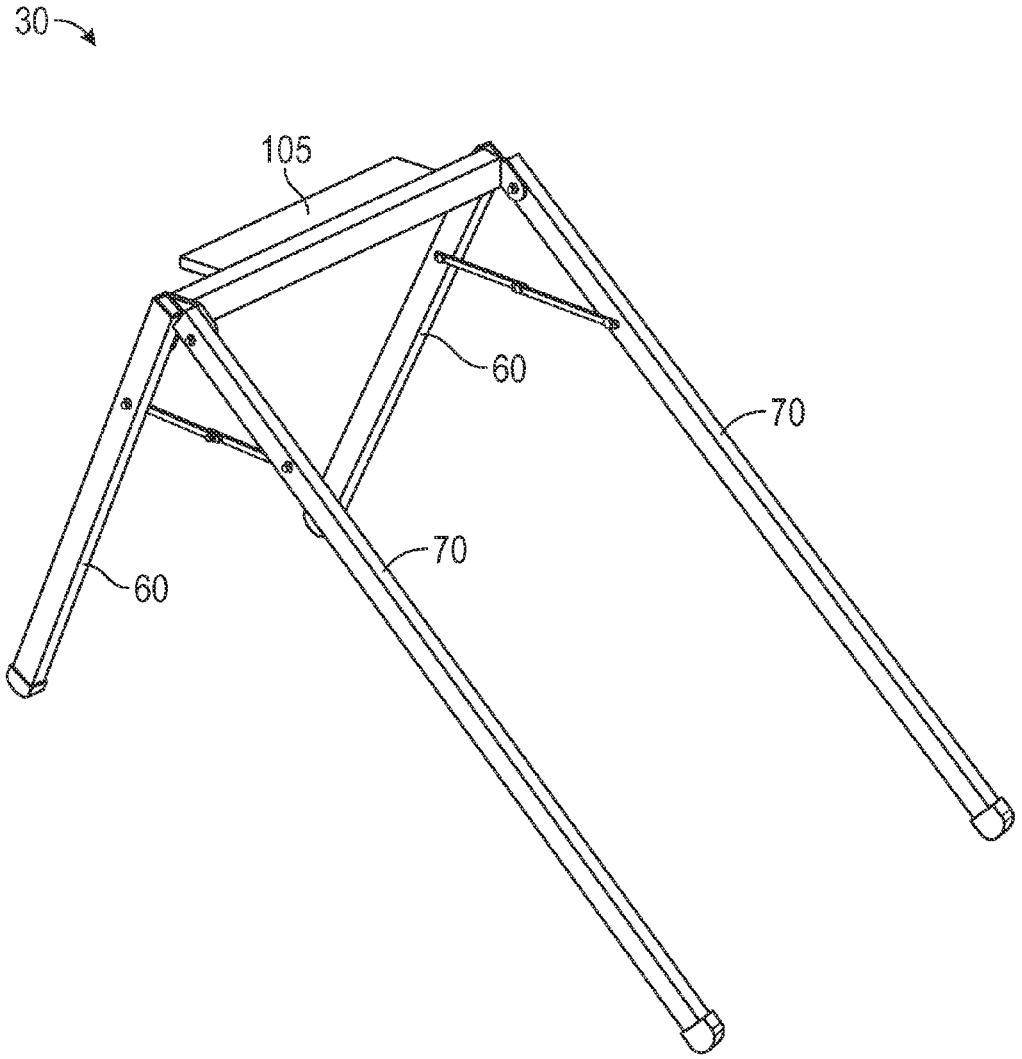
FIG. 3 is a perspective view of another embodiment thereof.

At least one rigid post 100 projects away from the cross bar 40, and at least one elastomeric band 110, when suspended from the at least one post 100, is capable of supporting the person 20 around his sacrospinal muscles 25 above the horizontal surface 15. Preferably the at least one post 100 is two posts 100 (FIGS. 1 and 2), but may also be a single flat bar 105 (FIG. 3). Each post 100 is preferably made from a rigid metal material welded onto the cross bar 40 or otherwise fixedly attached thereto. The at least one elastomeric band 110 may be a plurality of elastic bands, each with varying elasticity so as to allow persons 20 of varying weights to use the device 10 effectively.

Figure 4:
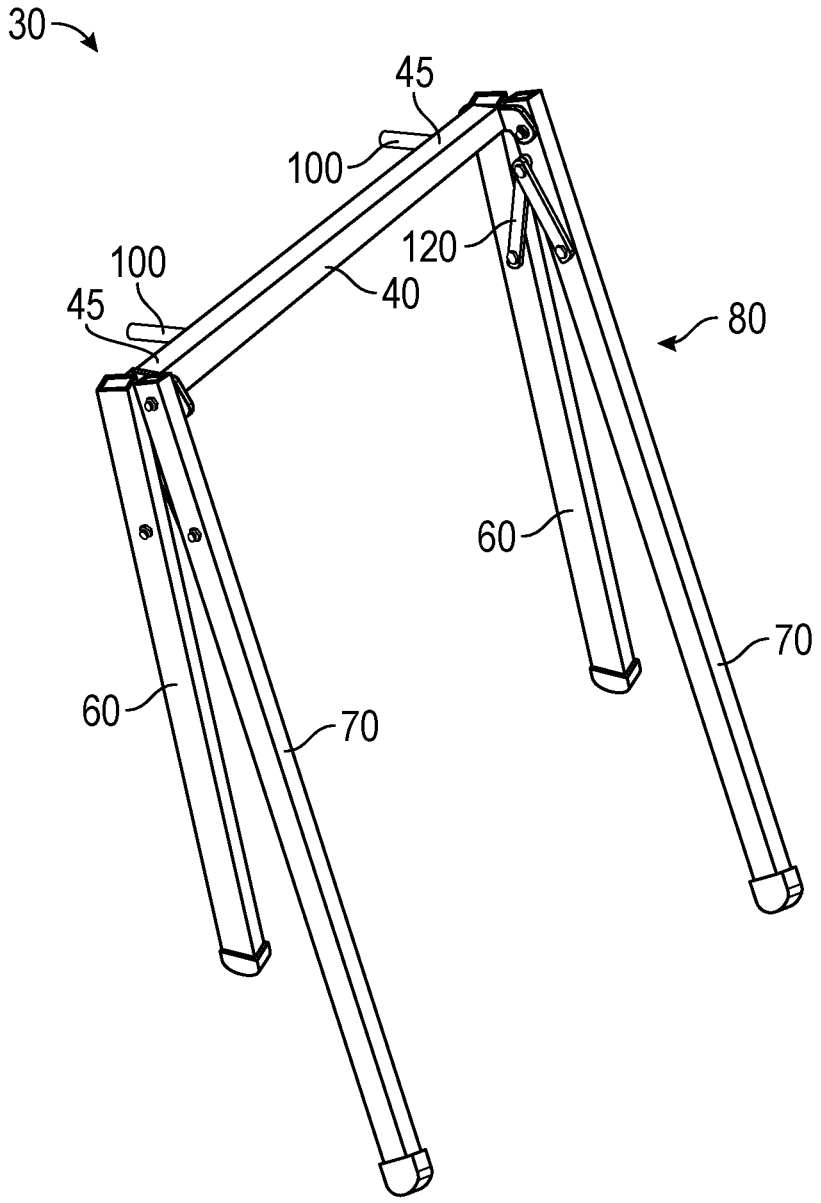
FIG. 4 is a perspective view of one embodiment in a collapsed configuration.

In one embodiment, a collapsible, locking angle bracket 120 is fixed between each pair of corresponding front and rear legs 60,70. Each angle bracket 120 when in a fully extended position 130 prevents the front and rear legs 60,70 from exceeding a predetermined angle α of separation. To reduce the chance of snagging the device 10 on other items when the front legs 60 are in the collapsed configuration 80, such an angle bracket 120 can assume a collapsed position 140 that does not extend past either the front or rear legs 60,70 (FIG. 4).

While a particular form of the invention has been illustrated and described, it will be apparent that various modifications can be made without departing from the spirit and scope of the invention. For example, rectangular bar stock is shown in the figures for the legs and cross bar, however any suitably rigid frame member of any shape could be just as readily used to accomplish the purposes of the present invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A device for promoting extension of the sacrospinal muscles of a person resting on a horizontal surface, comprising:

a stand having a horizontal cross bar fixed at opposing ends thereof with one each of a front pair of legs and a rear pair of legs, each front leg being pivotally fixed with the cross bar and configurable in a collapsed configuration wherein the front and rear legs are substantially parallel and proximate each other, and in an extended configuration wherein each front leg pivots outwardly to form an angle with one of the rear legs of between 45 and 120-degrees, wherein with the front and rear legs resting on the horizontal surface the cross bar is elevated above the horizontal surface sufficiently high enough to accommodate the person thereunder in a supine position;

at least one post projecting away from the cross bar to maintain a horizontal position in the extended configuration; and at least one elastomeric band that, when suspended from the at least one post, is capable of supporting the person around his sacrospinal muscles above the horizontal surface;

wherein the front legs are each shorter than the rear legs.

2. The device of claim 1 wherein the at least one post is two posts, each proximate the opposing ends of the cross bar.

3. The device of claim 1 wherein the at least one post is an elongated flat bar extending from proximate each opposing end of the cross bar.

4. The device of claim 1 further including a collapsible, locking angle bracket fixed between each pair of corresponding front and rear legs, each angle bracket when in a fully extended position preventing the front and rear legs from exceeding a predetermined angle of separation.

5. The device of claim 4 wherein each angle bracket can assume a collapsed position when the front legs are in the collapsed configuration, the angle bracket in the collapsed position not extending past either the front or rear leg.

6. The device of claim 1 wherein the at least one elastomeric band comprises a plurality of bands, each having a different elasticity.

* * * * *